United States Patent [19]

Torok et al.

[11] 4,189,701

[45] Feb. 19, 1980

[54] HYDROACOUSTIC DETECTION SYSTEM

[75] Inventors: Steve F. Torok, Southampton; Vincent A. Formica, Warminster; Jasper Caro, Levittown, all of Pa.

[73] Assignee: The United States of America as represented by the Secretary of the Navy, Washington, D.C.

[21] Appl. No.: 122,512

[22] Filed: Mar. 9, 1971

[51] Int. Cl.[2] ..... G08B 13/00

[52] U.S. Cl. ..... 367/2

[58] Field of Search ..... 340/2, 3 D, 5 R,6 R, 340/258 D

[56] References Cited

U.S. PATENT DOCUMENTS

| | | | |
|---|---|---|---|
| 2,961,869 | 11/1960 | Bagno | 340/3 D |
| 3,320,576 | 5/1967 | Dixon et al. | 340/5 R |

*Primary Examiner*—Richard A. Farley

*Attorney, Agent, or Firm*—R. S. Sciascia; Henry Hansen; G. H. Hennessey

[57] ABSTRACT

Various types of rivercraft propelled by motor, poling, sculling or paddling are found to generate broadband noise having a superimposed low frequency sinusoidal modulation. To detect the presence of such craft, a hydrophone, tethered in a river from a moored subsurface float is connected to a concealed transmitter located on the bank. The detected audio signal is demodulated and filtered. When classification criteria have been satisfied, a gate opens allowing the demodulation information to be processed by a logic circuit, which, if satisfied, causes the hydroacoustic signal to be transmitted over an RF link to a remote receiver station.

14 Claims, 6 Drawing Figures

HYDROACOUSTIC DETECTION SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The invention relates generally to the field of electronic acoustic detection, and more particularly, to passive detection of boats by acoustic analysis and logic circuitry to discriminate between true and false signals.

The need for passive military intelligence about enemy activity has encouraged the development of various "listening" systems which monitor the level of vibrations in specified areas. Although the art of detecting motorized equipment on land has now reached a sophisticated level, detection of rivercraft, such as sampans, has remained such an elusive task that visual or photographic detection was relied on almost exclusively. In Southeast Asia the complex network of rivers and streams which are navigable by shallow draft boats has made it impossible for military personnel to maintain thorough surveillance of logistics routes. Simple acoustic detectors for combustion engine noise are only marginally effective on land because of omnipresent aircraft noise; but motorless sampans, rowed, sculled or poled are currently used anyway. Active sonar detection has been consistently ruled out due to a variety of false alarm producing characteristics of the rivers such as floating debris.

The most baffling detection problem is presented by the sculled sampan. This type of rivercraft, indigenous to Southeast Asia, is a long shallow draft barge with a single long oar extending aft. As in the Venetian gondola, the operator alternately shoves and pulls the pivoted oar in a transverse direction imparting a zigzag or tacking forward motion to the vessel. A skilled sculler generates practically no audible noise since the single oar is always in the water. Because of this fact, air-acoustic or hydroacoustic detection of sculled sampans, although desirable, appeared to be impractical.

SUMMARY OF THE INVENTION

Accordingly it is the general purpose of the invention to demonstrate a technique for detecting rivercraft utilizing a characteristic of the low level noise which they produce. Another object of the novel detection system is to provide the previously doubtful capability of detecting various types of rivercraft including sculled, poled, rowed or motor driven boats with a single apparatus. A further object of the invention is to automatically discriminate against spurious hydroacoustic signals unrelated to target vessels.

These and other objects are achieved and the limitations of prior art devices overcome by providing apparatus to detect a low frequency sinusoidal modulation superimposed on broadband hydroacoustic energy generated by the action of water disturbed by the motion of a boat and its drive mechanism. A hydrophone, tethered in a river from a moored subsurface float, is connected to a concealed transmitter located on the bank. The audio signal is first filtered to about 1 to 3 kilocycles per second (kHz) and demodulated. The ambient level is held constant by a slow acting automatic gain control (AGC) line. The demodulated information is passed to a gate opened by a faster AGC line responsive to a relatively sudden increase in amplitude which lasts for a predetermined time but is not gradual or long enough in duration to raise the ambient level. When classification criteria have been satisfied, the gate opens allowing the low frequency demodulation information to be processed by a logic circuit which, if satisfied, causes a ten second hydroacoustic signal to be transmitted over an radio frequency (RF) link to a remote receiver.

DESCRIPTION OF THE PREFERRED EMBODIMENT

Figure 1:
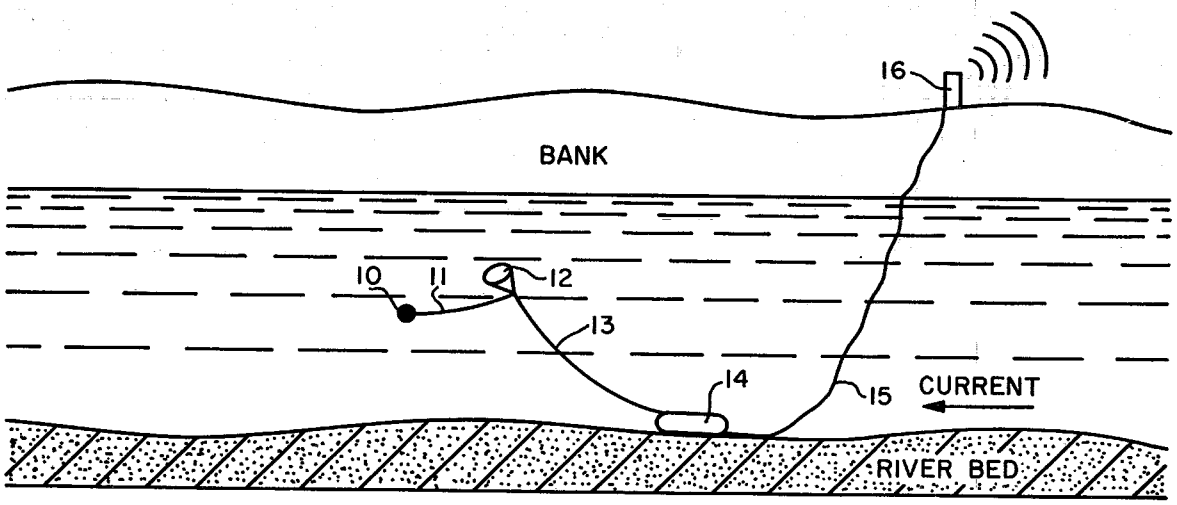
FIG. 1 is a pictorial representation in elevation of a longitudinal cross section of a river furnished with a hydroacoustic detection system according to the invention.

Referring to FIG. 1 in the drawings, a hydrophone 10 is disposed in a river in operating readiness to detect hydroacoustic signals. Hydrophone 10 is typically a ceramic type transducer which converts hydroacoustic energy, in the frequency range of 80 Hz to 7 kHz, to a proportional a.c. voltage. By means of line 11 hydrophone 10 is connected to a buoyant float 12 which in turn is connected via line 13 to an anchor 14. Anchor 14 might have a suitable pivoted hook mechanism to facilitate rigid engagement of the riverbed. Lines 11 and 13 are electrically connected at anchor 14 to slack line 15 which runs up the side of the river and its bank to a processing and transmitting unit 16 suitably concealed on the ground. Line 11 may be covered with an anti-strumming fringe to reduce spurious noise. Unit 16 may be of a similar configuration to the detector unit shown in FIG. 1 of the copending application Ser. No. 14834, filed Feb. 19, 1970, for a "Seismic Acoustic Detection Device" by Gimber et al, in which the di-pole transmitting antenna is an integral part of the housing.

Figure 2:
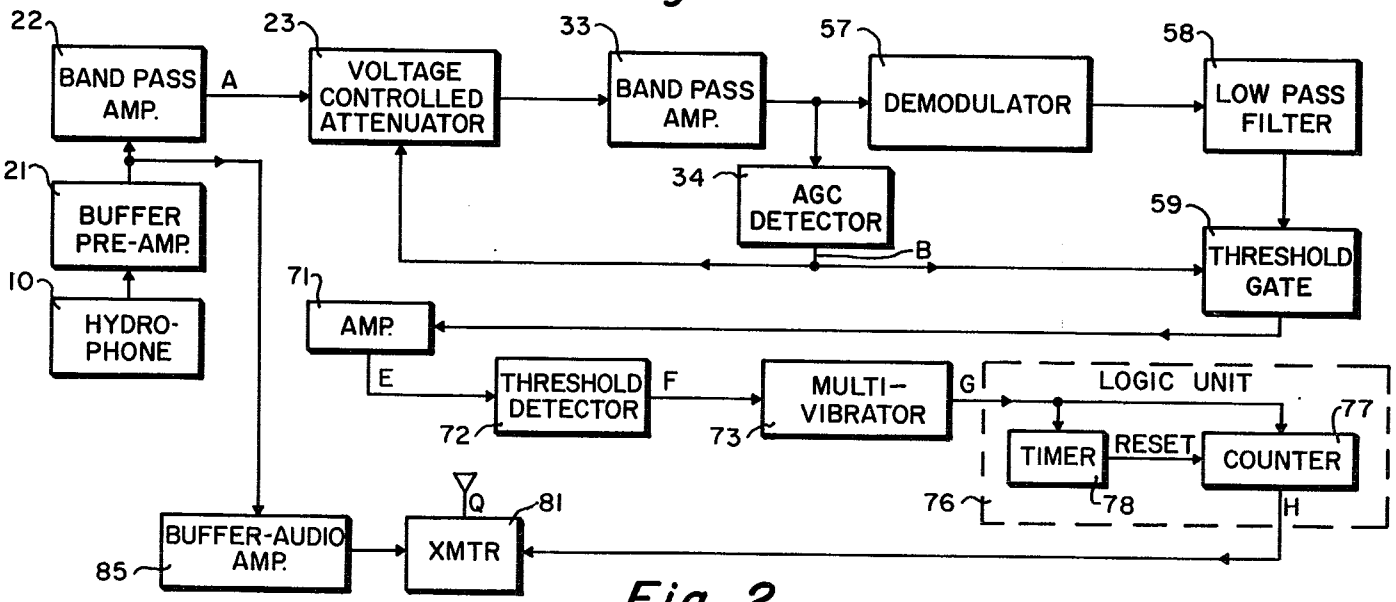
FIG. 2 is a block diagram of the detection system of FIG. 1.

Referring now to FIG. 2, the output of hydrophone 10 containing audio frequencies is passed to a buffer preamplifier 21 which provides some gain and transforms the hydrophone high impedance to a low output impedance for driving a bandpass amplifier 22. Amplifier 22 comprises a suitable conventional circuit containing feedback which provides a typical gain of 40 db and filters the signal to about 1 to 3 kHz. The filtered output of bandpass amplifier 22 is passed to a voltage controlled attenuator 23 which serves to maintain the ambient signal level constant despite relatively slow changes in background volume.

Figure 3:
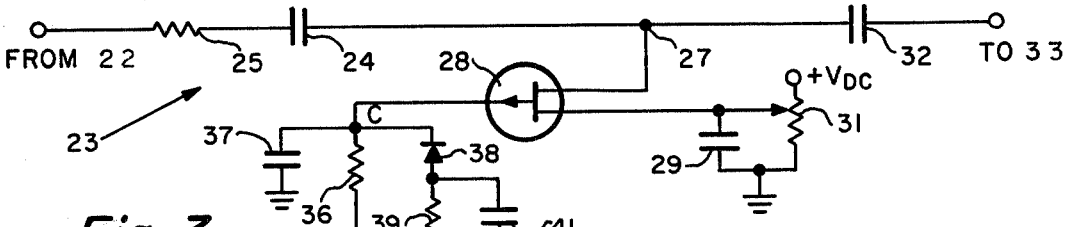
FIG. 3 is a schematic drawing of an embodiment of the voltage controlled attenuator of FIG. 2.

A suitable solid state design for attenuator 23 is shown in FIG. 3. In general circuit 23 shunts a variable portion of the output of amplifier 22 to ground in response to slow changes in the ambient level and passes the remainder of the signal from amplifier 22. The output from amplifier 22 is connected through a current limiting resistor 25 and decoupling capacitor 24 in series to a junction 27 variably connected to ground through a field effect transistor (F.E.T.) 28 operating in what is known as its linear or ohmic region. A capacitor 29 connected to the drain lead of F.E.T. 28 provides an a.c. ground. The drain is also connected to a variable voltage divider resistor 31 to allow adjustment of drain current having one end connected to ground and the other end connected to a source of positive voltage. Control voltage for the gate of F.E.T. 28 is provided from a feedback loop.

The output of attenuator 23 is taken from junction 27 through another decoupling capacitor 32 and fed to a bandpass amplifier 33 (FIG. 2) similar to amplifier 22. The output of amplifier 33 is fed back through an AGC detector 34 in a loop to control the gate of F.E.T. 28 in attenuator 23. The output of detector 34 is a highly responsive d.c. signal which, although inverted with respect to the amplitude of the hydrophone output, is representative of the average level of the signal from amplifier 33. Referring to FIG. 3, the output of AGC detector 34 is passed through an RC network in attenuator 23 comprising a large resistor 36 and large capacitor 37. The RC time constant should be very long, on the order of 15 minutes, so that the RC network acts as a very slow low-pass filter having a response in the neighborhood of 0.02 db per second. A fast recovery section comprising a diode 38 shunt around resistor 36 including an RC network of resistor 39 and grounded capacitor 41 provides for fast recovery of the attenuation when the output of AGC detector 34 changes back to its quiescent level. The attack rate of the fast recovery RC network should be around −1 db per second.

Figure 4:
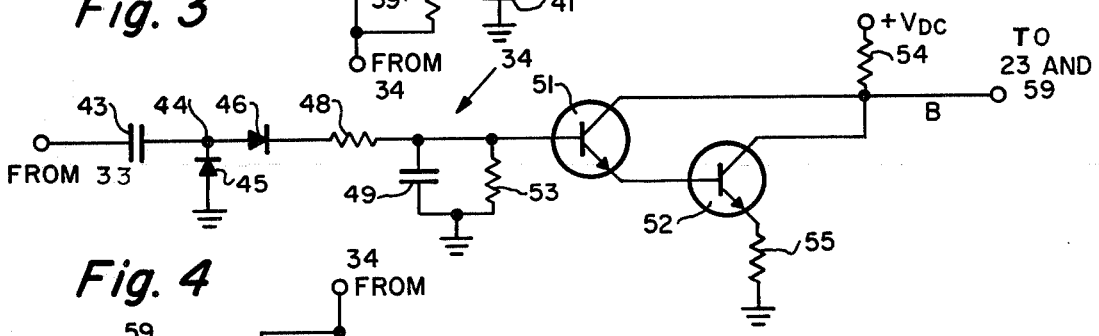
FIG. 4 is a schematic drawing of an embodiment of the AGC detector of FIG. 2.

Referring to FIG. 4, a suitable solid state design for AGC detector 34 includes a decoupling capacitor 43 having one side connected to receive the output of amplifier 33 and the other side connected to a junction 44 between a grounded reverse-biased diode 45 and a forward-biased diode 46. Diodes 45 and 46 provide a conventional voltage doubler detector. The other side of diode 46 is connected through a low-pass RC network comprising resistor 48 connected to grounded capacitor 49. The low-pass filter output is direct coupled to a high gain amplifier comprising cascaded transistors 51 and 52. Base 51 is connected through a large resistor, on the order of 1 megohm, to ground. The collectors of both transistors 51 and 52 are connected through a resistor 54 to a source of positive voltage. The emitter of transistor 51 feeds the base of transistor 54 whose emitter is grounded through a resistor 55. The d.c. output of AGC detector 54 is taken from the collector of transistor 52.

Referring again to FIG. 2 the output of amplifier 33 is also passed to a demodulator 57 which detects the low frequency information on the carrier. The demodulator may be of any suitable variety, for example, a half-wave diode detector with filtering to remove the carrier components. The low frequency output of demodulator 57 is filtered further in low-pass filter 58 having a sharp cutoff at 30 Hz. A suitable type of filter is provided by the Chebychev configuration, an active filter, using four poles of low pass to provide about 80 db per decade attenuation at 30 Hz.

Figure 5:
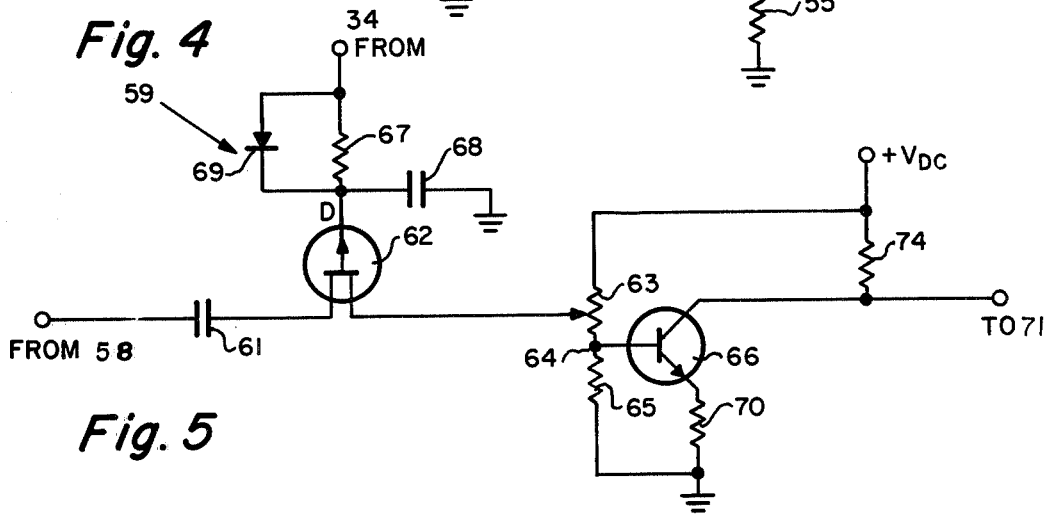
FIG. 5 is a schematic drawing of an embodiment of the threshold gate of FIG. 2.

The output of low-pass filter 58 is passed to a threshold gate 59 which interrupts or passes the output of filter 58 in response to the output of AGC detector 34. Referring to FIG. 5, the output of low-pass filter 58 is passed by a decoupling capacitor 61 to the source lead of an F.E.T. 62 whose drain lead is connected to a variable voltage divider 63 connected at one end to a source of positive voltage and at the other end via junction 64 to a grounded resistor 65. To operate F.E.T. 62 in the switching mode the gate is connected through an RC network to receive the output of AGC detector 34, the pinch-off voltage being determined by the position of the wiper on resistor 63. The RC network comprises a series resistor 67 connected to a grounded capacitor 68 providing a time constant of about 3 seconds. By comparison, this time constant is about ⅛ of 1% of the constant provided by resistor 36 and capacitor 37 in attenuator 23. A fast discharge path is provided by a diode 69 providing a shunt around resistor 67 in gate 59. When F.E.T. 62 is conducting due to the voltage on its gate, the modulation output of filter 58 is allowed to pass through the gate via one stage of amplification provided by transistor 66 whose base is connected to junction 64. The collector lead transistor 66 provides the gate 59 output and is connected to a source of positive voltage through resistor 74. The emitter is grounded through resistor 70.

Referring again to FIG. 2, the low frequency output of gate 59, when passed, is fed through an amplifier 71 to a threshold detector 72 providing a binary output indicating whether the output of amplifier 71 is above or below a predetermined threshold at any given time. When the output of threshold 72 indicates that the threshold is exceeded, a multivibrator 73 is turned on to provide a train of pulses which is processed in a logic unit 76 comprising a counter 77 and a reset timer 78. Timer 78 is begun by the occurrence of one pulse from multivibrator 73 and resets counter 77 to zero after a selected interval of time, typically 10 seconds. Counter 77 is implemented to provide an output signal when the count reaches a predetermined number such as two or four. Implementation of counter 77 requires only a series of conventional flip-flops.

The binary output of logic unit 76, that is, the output of counter 77, is used to turn on a transmitter 81. Transmitter 81 is typically equipped with a conventional timer which holds the transmitter "ON" for about 10 seconds after activation by logic unit 76. The timer in transmitter 81 would normally be connected to inhibit logic unit 76 during the 10 second transmission time. When transmitter 81 is "ON", the raw, unprocessed hydroacoustic information from hydrophone 10 is passed to transmitter 81 via buffer preamplifier 21 and buffer-audio amplifier 85, which is a moderate gain, broadband amplifier with low output impedance. The RF carrier of transmitter 81 is modulated by the hydroacoustic information.

OPERATION

Although rivers are characteristically noisy, it has been found by experimentation that all types of rivercraft, propelled by motors, paddles, etc., produce broadband high frequency noise related to the motion of the propelling mechanism and the boat through the water. Reliable data has been collected indicating that the average amplitude of broadband noise is modulated at a low frequency, in all cases, below 30 Hz, during passage of a vessel. The mechanism and reason for this modulation has not been identified with precision, but the usefulness of this effect is nonetheless evident. It seems clear, however, that the noise is connected somehow with the bursting of small air bubbles in the water surrounding the propelling mechanism, whether it is a paddle, a sculling oar or a propeller blade. The low frequency modulation may be related to the stroking cycle of the operator, or in the case of a motor, to the r.p.m. Another theory suggests that the effect is totally independent of the propelling mechanism and is related instead to the movement of the boat's hull through the water, the modulation being due to a relaxation effect caused by interaction of the bursting air bubbles.

Referring to FIG. 1, transmitter unit and processor 16 would typically be designed to include a storage department for hydrophone 10, float 12 and anchor 14, and their connecting lines. For detecting river traffic the hydrophone, float and anchor would first be deployed and set in midstream. Ordinarily this can be easily accomplished by lobbing the hydrophone and mooring assembly out into the river. Next, unit 16 is concealed on the riverbank and given the proper orientation for its internal antenna.

Referring to FIG. 2 noise picked up by the broadband hydrophone 10 is limited to the 1 to 3 kHz band by amplifiers 22 and 33. While the precise frequencies and bandwidth are not critical, this range is preferred for several reasons. The lower end of the 1 to 3 kHz band was chosen to exclude other types of noise such as aircraft transit noise which predominate at the lower frequencies. Moreover, the acoustical energy distribution produced by moving boats, although spectrally broad, was found to be more concentrated above 1 Hz. The upper end of the high frequency bandwidth was chosen in part to exclude certain strong frequencies related to rain and also because hydrophone response normally deteriorates above this range.

The basic reason for the AGC loop controlling attenuator 23 is to hold the spectrum of interest at a constant level. On occasions the water environment may gradually become much more noisy at the 1 to 3 kHz band. This is true, for example, during rain. Also the noise emitted by water life, such as fish, otters, snapping shrimp and other indigenous sound producing creatures, will change throughout the day. The AGC loop is thus designed to correct slow changes in level. Referring to FIG. 3, that is the reason for the long time constant produced by resistor 36 and capacitor 37 providing 0.02 db per second correction for slow changes, on the order of 10 to 20 minutes.

After the 1 to 3 kHz band has been demodulated and filtered in units 57 and 58, it would appear that the detection procedure would be complete upon identifying a modulation frequency below 30 Hz. This is not the case, however. Since there is so much false alarm generating noise in the water environment, still another requirement must be placed on the hydroacoustic noise. It has been found that rivercraft noise can be distinguished from other types of noise by the rate of increase of the amplitude in the 1 to 3 kHz band as a boat approaches and passes the hydrophone. As stated before, slow changes in level are evened out by the AGC control. Now, some way had to be found to eliminate changes in signal strength which are too fast. Threshold gate 59 serves this purpose by providing a relatively quick bypass filter comprising resistor 67 and capacitor 68 which exhibit a time constant of about three seconds. If the change in signal strength at the input to the AGC detector 34 is too fast the gate of F.E.T. 62 will not be brought down to the pinch-off voltage established by resistor 63.

Figure 6:
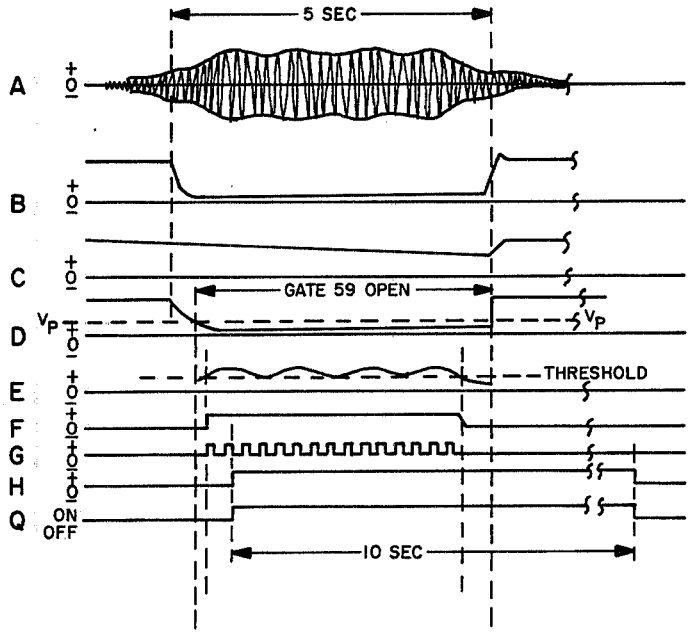
FIG. 6 is a timing diagram illustrating typical waveforms for the detection system of FIG. 2.

Referring now to FIG. 6, a typical detection situation will be illustrated to emphasize the interaction of threshold gate 59 and voltage controlled attenuator 23. The letters A through Q identifying the voltage lines correspond to specific points in the circuit of FIG. 2 and accompanying schematic drawings of FIGS. 3, 4 and 5. Line A shows the 1 to 3 kHz band output of amplifier 22 which is a replica of the actual noise in the river with the exception of frequencies outside of the band. It should be emphasized however that modulation frequencies far lower than the high frequency band may be superimposed on the average amplitude of the high frequency noise. Thus in line A of FIG. 6 a typical target waveform is represented showing a relatively abrupt rise in noise amplitude for a five second period during which the average amplitude of the noise is modulated at a frequency in the neighborhood of 1 Hz which might correspond roughly, for example, to a sculling or paddling motion. Note that the output of AGC detector 34 (FIG. 4), line B, remains at a positive quiescent level prior to the five second interval. With the rise in amplitude in line A, line B falls suddenly due to the high gain of the amplifier stages in AGC detector 34 (FIG. 4). The AGC voltage represented in line B is continuously fed back to attenuator 23 (FIG. 3). The integrating effect of capacitor 37 prevents the AGC voltage from having an immediate effect on the gate of F.E.T. 28. Note that the voltage on line C representing the gate voltage gradually decreases as the charge builds up. However, in this case since the duration of the increase in signal level in line A is far less than the time constant for capacitor 37 and resistor 36, the amount of attenuation by attenuator 23 will be negligible. Of course, the slope in line C has been exaggerated for clarity. Threshold gate 59 will, however, react quite differently to this abrupt change in AGC voltage from unit 34. Since the duration of the increase in line A is on the same order as the time constant of resistor 67 and capacitor 68 (FIG. 5), the gate of F.E.T. 62, line D in FIG. 6, is brought below the pinch-off voltage ($V_p$) set by variable voltage divider 63. Between the points where line D crosses the dashed line $V_p$, threshold gate 59 will be open, that is F.E.T. 62 will be conducting. As soon as gate 59 is opened the demodulated envelope of line A furnished by demodulator 57 and low-pass filter 58 is passed through gate 59 to amplifier 71 whose output, line E of FIG. 6, is threshold detected in detector 72. Line F represents the binary output of detector 72 which is high when line E exceeds the threshold level. The high output of detector 72 activates multivibrator 73 whose output in line G is a pulse train which preferably has a repetition rate of about 5 Hz. The first pulse in line G starts timer 78. As soon as counter 77 has counted two pulses, the assumed requirement in this example, its output, line H of FIG. 6, goes high and activates transmitter 81 which runs for ten seconds by virtue of an internal clock which inhibits counter 77 and timer 78 until the end of the clock's time period. Since in this instance a target signal has been illustrated, timer 78 plays no role since counter 77 does count the necessary two pulses within the ten second period provided by timer 78. However, if the ten second period of timer 78 elapsed before the counter 77 had counted two full pulses, the output of timer 78 would have reset counter 77. During the ten second period during which transmitter 81 is transmitting, the RF carrier is modulated by the actual unprocessed hydroacoustic signal provided by buffer-audio amplifier 85.

The transmitted hydroacoustic signal is received at a remote processing station where an operator can make a qualitative analysis of the signal to provide further target discrimination. A most costly alternative would be to provide spectral analysis of the transmitted signal or even for the demodulated signal below 30 Hz produced for example in line E.

If, in line A, the burst of noise had not lasted for five seconds but had disappeared instead in less than one second, gate 59, illustrated in line D, would not have had a chance to open since the voltage at the gate of F.E.T. 62 would have remained above pinch-off. Fast bursts of modulated noise in the 1 to 3 kHz range are produced by such incidents as fish jumping or tree branches falling into the water. The only other case to consider is the long duration case where the signal gradually builds up and lasts for 10 to 15 minutes, for example. In this case gate 59 would open but for the fact that voltage controlled attenuator 23 would pull the signal back down and raise the voltage in line D above the pinch-off voltage to prevent gate 59 from opening.

The function of the low frequency part of the apparatus is to demodulate or detect the modulation frequency below 30 Hz. It should be noted that capacitor 61 in FIG. 5 prevents pure d.c. from being passed by gate 59. This fact plus the preferred requirement of two counts in ten seconds, corresponding to a threshold amplitude, means that there must in fact be some frequency modulation of the noise in the 1 to 3 kHz band for a true target. By setting the count requirement very low, it is obvious that the modulation need be only very slight because the two counts may occur at opposite ends of the ten second period and still qualify. It should be noted, however, that low-pass filter 58 with its 30 Hz bandwidth makes the system insensitive to instabilities in the modulation components as the low-pass filter integrates all signal energy contained in the 30 Hz band.

It should be apparent by now that the operation of the detection system is based on the concurrence of a number of different frequency and time requirements. Attenuator 23 and gate 59 may be viewed as one way of implementing a very low frequency bandpass filter using AGC feedback. Attenuator 23 only attenuates signal changes in the neighborhood of ten minutes duration and above. Gate 59, on the other hand, in effect attenuates everything but signal increases which last longer than two seconds. Combining these two effects provides a kind of bandpass filter, which can be demonstrated mathematically to correspond to a frequency region from 0.001 to 0.5 Hz, approximately. Simultaneously the demodulator and low-pass filter 57 and 58 respectively require that the signal increase by accompanied by a low frequency modulation below 30 Hz.

The resultant combination has proved to be the most effective detection system ever produced for detecting various types of rivercraft with one apparatus. It not only detects the very silent sculled, poled or rowed sampans but also detects motor driven vessels which produce noise related to the engine r.p.m. That is, an r.p.m. of for example 1000, will modulate the high frequency 1 to 3 kHz band at some multiple of about 17 Hz due to the rotation of the propeller blades or perhaps to the firing of the cylinders.

In some unusual applications it may be found that the low frequency section of the system of FIG. 2 does not add anything to the detection capability provided by detector 34, attenuator 23 and gate 59. In fact, the 0 to 30 Hz information passing through the gate may be completely unrelated to the event which is sought to be detected. In these situations, a useful modification might be to eliminate demodulator 57, low-pass filter 58, amplifier 71 and threshold detector 72 and use gate 59 to turn on multivibrator 73. Or if the amplifier 71, detector 72 and multivibrator 73 circuitry could not be tampered with for some reason, it would be possible to have gate 59 simply turn on a low fixed frequency oscillator to feed amplifier 71.

It should also be obvious that, since gate 59 and attenuator 23 act in opposition to each other to create a very low frequency bandpass region, they could in some cases be replaced with an appropriately tuned bandpass filter. However the AGC implementation employed here has fewer components, thus reducing cost. Other alternatives include changing the cutoff frequencies of the filters in amplifiers 22 and 23 and low-pass filter 58 to meet optimum system requirements in different situations. In addition, it is possible to replace low-pass filter 58 with an active phase lock loop system. This implementation would only lock onto sinusoidal modulations and might provide increased sensitivity and false alarm rejection at the expense of more complex hardware.

In use the invention provides an effective means of detecting manual or motor propelled vessels while exhibiting high immunity to false alarms, even in the noisy environment produced by continuous aircraft transits. Even during a rainstorm it should be possible to acoustically detect sampans as the background noise is normalized by the AGC loop. The most important result of the invention is that its automatic capability liberates military personnel from the task of personally monitoring river traffic. The system is simple, easy to install and fits easily into a concealable housing. By using two units spaced apart on one river it is also possible to detect the direction of river traffic. By utilizing a complete network of these units, a single operator located at a remote station can plot rivercraft movements in a large area to provide the necessary intelligence for predicting enemy actions.

It will be understood that various changes in the details, materials, steps and arrangements of parts, which have been herein described and illustrated in order to explain the nature of the invention, may be made by those skilled in the art within the principle and scope of the invention as expressed in the appended claims.

What is claimed is:

1. A hydroacoustic detection system for detecting the movement of a body in water, comprising:

hydrophone means;

bandpass means operatively connected to receive the hydrophone means output to provide a filtered output limited to a predetermined frequency band;

detector means operatively connected to receive said bandpass means output for producing a replica output of a modulation frequency therein;

low-pass means operatively connected to receive said detector means output for producing an output below a predetermined cutoff frequency indicative of the movement of said body;

threshold detector means operatively connected to receive said low-pass means output for providing a binary output indicative of exceedence of a predetermined threshold; and transmitter means operatively connected to receive and transmit said hydrophone means output in response to one state of said threshold detector means output.

2. A detection system according to claim 1 further comprising:

logic means operatively connected to receive said threshold detector means output for providing a binary output indicative of a predetermined number of occurrences of one state of said threshold detector means output within a selected time interval.

3. A detection system according to claim 2 further comprising:

a feedback loop operatively connected to receive said bandpass means output for controlling said output in response to changes in level thereof.

4. A detection system according to claim 3 further comprising:

gate means interposed between said threshold detector means and said low-pass means having a control input operatively connected to said bandpass means to pass said low-pass means output in response to a predetermined rate of increase and duration of said bandpass means output.

5. A detection system according to claim 4 further comprising:

said feedback loop including AGC detector means operatively connected to receive said bandpass means output for conversion thereof to a d.c. signal output indicative of the average amplitude of said bandpass means output and variable attenuator means connected between said AGC detector means and said bandpass means having a low-pass filter network connected to receive said AGC detector output for selectively attenuating said bandpass means output in response to gradual increases therein; and said gate means including a low-pass filter network, faster acting than said attenuator means low-pass filter network, operatively connected to receive said AGC detector means output for passing said low-pass means output in response to less gradual increases in said bandpass means output.

6. A detection system according to claim 5 further comprising:

said logic means including a clock pulse generator operatively connected to receive said threshold detector output for producing a train of pulses in response to the one state thereof, counter means operatively connected to count the number of said pulses for producing binary output when a predetermined number is counted, and timer means operatively connected between said clock pulse generator means and said counter means for resetting said counter after said selected interval of time.

7. A detection system according to claim 6 further comprising:

transmitter means operatively connected to receive and transmit said hydrophone means output in response to one state of said counter means output.

8. A detection system according to claim 7 further comprising:

an electrically conductive flexible line operatively connecting said hydrophone means to said bandpass means;

an anchor rigidly attached to said line; and a float rigidly attached to said line between said anchor and said hydrophone means;

whereby said hydrophone means can be tethered at a desired depth in a river.

9. A detection system according to claim 6 further comprising:

said bandpass means predetermined frequency band being above 1 kHz.

10. A detection system according to claim 9 further comprising:

said bandpass means predetermined frequency band being from about 1 kHz to about 3 kHz.

11. A detection system according to claim 10 further comprising:

said low-pass means predetermined cutoff frequency being about 30 Hz.

12. A detection system according to claim 11 further comprising:

said attenuator means low-pass filter network having a time constant over 100 times as long as the time constant of said gate means low-pass filter network.

13. A detection system according to claim 12 further comprising:

said attenuator means low-pass filter network time constant being about 15 minutes; and said gate means low-pass filter network time constant being about 3 seconds.

14. A detection system for indicating the presence of a moving body in water, comprising:

hydrophone means;

high bandpass filter means operatively connected to receive the hydrophone means output;

detector means operatively connected to receive said high bandpass filter means output for producing an output indicative of the average amplitude thereof; and low bandpass filter means responsive to the presence of frequencies in a band below 1 Hz including a variable attenuator operatively connected to said high bandpass filter means having a low-pass filter network with a selected time constant connected to receive said detector means output for selectively attenuating said high bandpass filter means output in response to gradual increases therein, and gate means operatively connected to receive a signal indicative of said high bandpass filter means output having a low-pass filter network with a time constant at least 100 times shorter than said attenuator means low-pass filter network time constant, connected to receive said detector means output for passing said signal indicative of said high bandpass filter means output in response to less gradual increases in said high bandpass filter means output.

* * * * *